US006474098B2

(12) United States Patent
Perrine et al.

(10) Patent No.: US 6,474,098 B2
(45) Date of Patent: Nov. 5, 2002

(54) INTEGRATED CONDENSER-RECEIVER DESICCANT BAG AND ASSOCIATED FILTER CAP

(75) Inventors: Glenn D. Perrine, Eaton, OH (US); David V. Flaugher, Beavercreek, OH (US); John M. Evans, Piqua, OH (US)

(73) Assignee: Stanhope Products Company, Brookville, OH (US)

( * ) Notice: Subject to any disclaimer, the term of this patent is extended or adjusted under 35 U.S.C. 154(b) by 0 days.

(21) Appl. No.: 09/756,433

(22) Filed: Jan. 8, 2001

(65) Prior Publication Data

US 2002/0092317 A1 Jul. 18, 2002

Related U.S. Application Data

(60) Provisional application No. 60/178,595, filed on Jan. 28, 2000.

(51) Int. Cl.[7] ..... F25B 43/04; B01D 24/00

(52) U.S. Cl. ..... 62/475; 62/474; 210/287

(58) Field of Search ..... 62/474, 475, 512, 62/292, 195; 55/428, 429; 210/287, 282, 446, 689, DIG. 6, DIG. 7; 206/524.2, 524.5; 383/109

(56) References Cited

U.S. PATENT DOCUMENTS

| | | | | |
|---|---|---|---|---|
| 4,291,548 A | | 9/1981 | Livesay | |
| 4,496,478 A | | 1/1985 | Kish | |
| 4,838,947 A | * | 6/1989 | Levy et al. | 210/282 X |
| 4,973,448 A | * | 11/1990 | Carlson et al. | |
| 5,149,453 A | | 9/1992 | Parekh | |
| 5,372,429 A | * | 12/1994 | Beaver, Jr. et al. | 383/109 |
| 5,440,919 A | | 8/1995 | Cooper | |
| 5,718,697 A | * | 2/1998 | Chauvette et al. | |
| 5,813,249 A | | 9/1998 | Matsuo et al. | |
| 5,837,039 A | | 11/1998 | LeConey et al. | |
| 6,038,881 A | | 3/2000 | Murray | |
| 6,170,287 B1 | * | 1/2001 | Leitch et al. | 62/474 |

FOREIGN PATENT DOCUMENTS

| | | |
|---|---|---|
| JP | 443271 | 2/1992 |

* cited by examiner

*Primary Examiner*—Chen-Wen Jiang
(74) *Attorney, Agent, or Firm*—Biebel & French

(57) ABSTRACT

An adsorbent package is provided for use within the sealed canister of a fluid flow tube of an air conditioning system. The adsorbent package includes a desiccant bag formed of a pouch having a sealed first end and a substantially cylindrical second end. A filter cap is slidably and sealingly received within the second end of the pouch. The cap includes a resilient sealing ring formed proximate a porous end wall. The sealing ring slidably and sealingly engages an inner surface of the canister. The package is constructed of a non-woven spun bonded nylon and can therefore be snugly received within the tight confines of fluid flow tube or canister sections of an integrated condenser receiver.

13 Claims, 8 Drawing Sheets

INTEGRATED CONDENSER-RECEIVER DESICCANT BAG AND ASSOCIATED FILTER CAP

RELATED APPLICATION

The priority benefit of U.S. Provisional Patent Application No. 60/178,595 filed Jan. 28, 2000 is claimed.

BACKGROUND OF THE INVENTION

Desiccant containing packets have been employed in small diameter receivers that are juxtaposed along one of the condenser headers in an integrated type condenser-receiver. These integrated condenser-receiver structures eliminate the need for separate tubing to connect the condenser with the receiver and have become popular due to their reduced spatial requirements. For instance, in one integrated condenser-receiver disclosed in U.S. Pat. No. 5,813,249, the overall dimensions of the integral unit are from about 300 mm–400 mm in height and about 300 mm–600 mm in width.

In the integrated type condenser-receiver design reported in the '249 patent, the axes of the receiver canister and associated header are parallel with the canister attached to and contiguous with the header. The desiccant containing package positioned in the receiver dries refrigerant liquid (and the oil and moisture entrained therein) prior to passage of the dried refrigerant to a supercooler unit that is formed integrally with the condenser.

Due to the small diameter of the receiver canister in such integrated structures, the desiccant containing package which is to be positioned therein must also comprise a small diameter substantially cylindrical pouch or packet. Typically, automotive manufacturers desire placing a fluorescent tracer dye wafer or the like in the desiccant package so that leaks in the refrigeration system can be readily determined by use of an ultraviolet light source. See for instance U.S. Pat. Nos. 5,149,453 and 5,440,910.

At present, these tracer dye wafers are available in disk shapes having a ⅜" diameter and ⅜" thickness. Typically, commercial felts that are used to form desiccant containing packages are on the order of about 0.060"-0.120" in thickness. When such conventional materials are used to form a desiccant package for reception within these small diameter receivers, the internal diameter and the internal cross sectional area thereof are so small as to hinder insertion of a dye wafer therein.

One bag used in the receiver of an integrated condenser-receiver is fabricated by folding over the felt or other bag material and then sewing the one edge shut, thus forming a lopsided tube. One end of this tube is then sewn shut and the packet created by this is filled with desiccant and then the open end is sewn shut creating the bag. The sewn edge along the length of the bag protrudes out from the surface and creates a hindrance to installing the bag in a small diameter integrated receiver condenser. The construction of the bag is labor intensive and therefore expensive to fabricate.

SUMMARY OF THE INVENTION

We have found that a very thin, non-woven porous nylon material may beneficially be used to form a desiccant containing package that will fit snugly within the aforementioned small diameter receiver or other fluid flow tube or canister of an integrated type condenser-receiver. The thinness of the material, when formed into a cylindrical cross-sectioned pouch or package, will allow sufficient room within the package for insertion of a tracer dye wafer or the like therein. At the same time, the porosity of the fabric will permit adequate fluid permeability so that the refrigerant liquid can permeate the package and dry upon contact with the desiccant housed therein.

Specifically, we have found that non-woven spun bonded nylon material available under the Cerex PBN-II designation from Cerex Advanced Fabrics, Pensacola, Florida, is especially efficacious in forming these small diameter desiccant packages. This material is also sometimes referred to as being a point bonded nylon. Although others have proposed using this particular material to form a saddle-bag shaped absorbent unit of automotive accumulators (see file history for U.S. Pat. No. 6,038,881), one artisan has opined that such use is disfavored since allegedly the material is "difficult to form thermally into concave configurations, had high scrap rates and downtime, and . . . lower thermal strength." (See file history of U.S. Pat. No. 6,038,881, Incovia Declaration, paragraphs 7 and 9.)

Accordingly, it was surprising to find that this particular non-woven material could be easily and durably formed by ultrasonic sealing methods into a small diameter, generally cylindrical shape so as to house desiccant and a tracer dye wafer therein. We have found that these generally cylindrical packets are especially useful when positioned as a desiccant package in the receiver associated with the aforementioned integrated condenser-receiver.

Additionally, so as to enhance the filtering efficacy of the desiccant package, in another aspect of the invention, a solid particle filter component and an enlarged rim area of the structure are provided as a component of the pouch to minimize bypassing of the desiccant containing package by refrigerant fluid and to enhance filtering efficacy.

The present invention thus provides an adsorbent package adapted for use in a fluid flow tube of an automotive refrigerant system. The fluid flow tube may be, for example, an accumulator or receiver/drier canister or the like. The fluid flow tube or canister has a substantially cylindrical side wall and opposing first and second end walls. An inlet opening is formed within the side wall proximate the first end wall, while an outlet opening is formed within the side wall proximate the second end wall.

The adsorbent package of the present invention includes a desiccant bag having a pouch preferably formed from a tubular strip of non-woven spun bonded nylon material. A first end of the pouch is sealed in a conventional manner to form an end seam. The interior, as defined by the pouch, is then filled with an appropriate granular adsorbent material.

In one embodiment, the second end of the pouch slidably and sealingly receives a filter cap. The filter cap includes a body having a cylindrical side wall and a porous end wall which is preferably formed integrally with the side wall. The end wall includes a plurality of apertures sized so as to permit refrigerant fluid flow but to restrict desiccant from passing therethrough. The cap further includes an attachment device for securing the pouch of the desiccant bag to the body. In one embodiment, the attachment device preferably comprises an annular ring extending radially outwardly from the body of the cap and positioned along a skirt portion extending from the cap body. A resilient sealing ring is formed proximate the porous end wall and extends radially outwardly from the body. The sealing ring forms a living seal by slidably and sealingly engaging an inner surface of the cylindrical side wall of the canister.

In operation, refrigerant flows through the inlet opening of the canister and is directed through the porous end wall of the cap by the sealing ring. As may be appreciated, all fluid flow is directed through the cap by sealing engagement between the sealing ring and the cylindrical side wall of the canister. The refrigerant flows through the cap, passing through the desiccant and pouch of the desiccant bag. The desiccant removes moisture from the refrigerant while the pouch filters solid particles from the refrigerant.

The invention will be further described in conjunction with the appended drawings and following detailed description.

DETAILED DESCRIPTION OF THE PREFERRED EMBODIMENT

Figure 1:
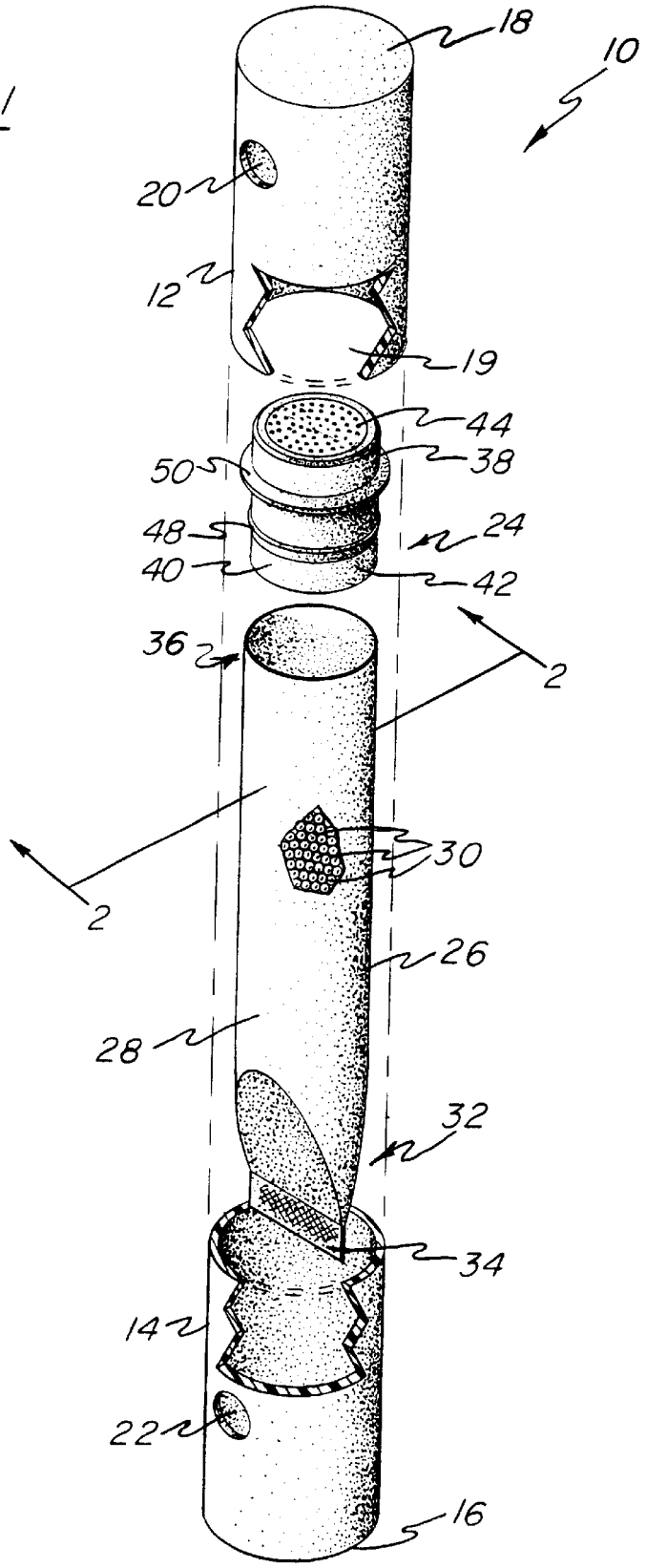
FIG. 1 is a broken away perspective view of a fluid flow tube incorporating an adsorbent package in accordance with the present invention, wherein the adsorbent package is shown partially exploded.

Referring initially to FIG. 1 of the drawings, a fluid flow tube of an air conditioning system, particularly an air conditioning system used in the automotive field, is illustrated generally at 10. The fluid flow tube 10 comprises a conventional canister 12 including a cylindrical side wall 14 and opposing first and second end walls 16 and 18 defining a sealed chamber 19. An inlet opening 20 is formed within the cylindrical side wall 14 proximate the second end wall 18. Likewise, an outlet opening 22 is formed within the side wall 14 proximate the first end wall 16. Both the inlet and outlet openings 20 and 22 are in fluid communication with the chamber 19.

Figure 2:
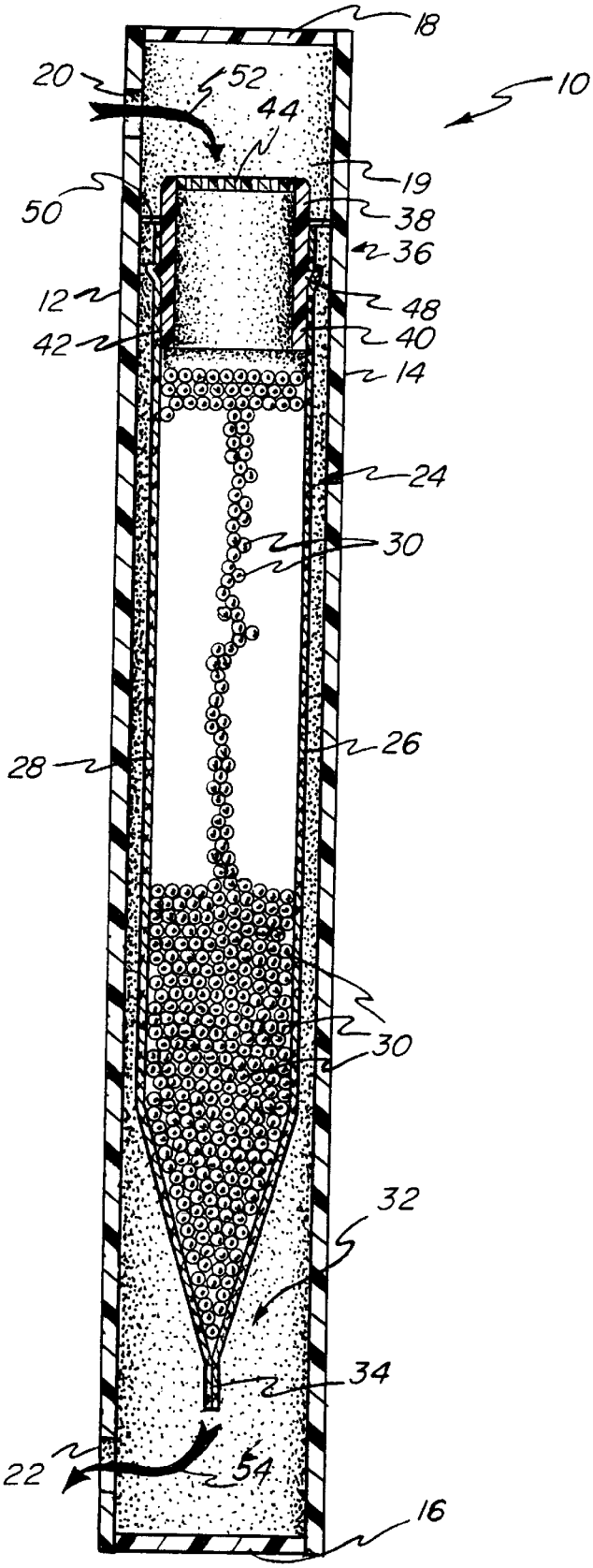
FIG. 2 is cross-sectional view taken along the plane represented by the lines and arrows 2—2 of FIG. 1.

Referring further to FIGS. 1 and 2, the adsorbent package 24 of the present invention is received within the chamber 19 of the canister 12. The adsorbent package 24 includes a desiccant bag 26 having a pouch 28. The pouch 28 is formed from a fluid permeable material, preferably a non-woven spun bonded nylon as set forth above. More particularly, the pouch 28 is preferably made from a tubular sleeve of the spun bonded nylon material which has been cut into lengths and filled with an appropriate granular adsorbent material or desiccant 30.

A first end 32 of the pouch 28 is sealed along a seam 34. In the preferred embodiment, this end seam is formed by suitably tucking in a portion of the tube side wall and flattening an end portion under conditions which causes the spun bonded nylon material to fuse together and seal the end of the pouch 28. Preferably, the sealing is effected by use of an ultrasonic welding machine. However, RF and heat sealing methods can also be mentioned.

A second end 36 of the pouch 28 is substantially cylindrical and concentrically receives a filter cap 38. The filter cap 38, in turn, is concentrically received within the side wall 14 of the canister 12.

Figure 3:
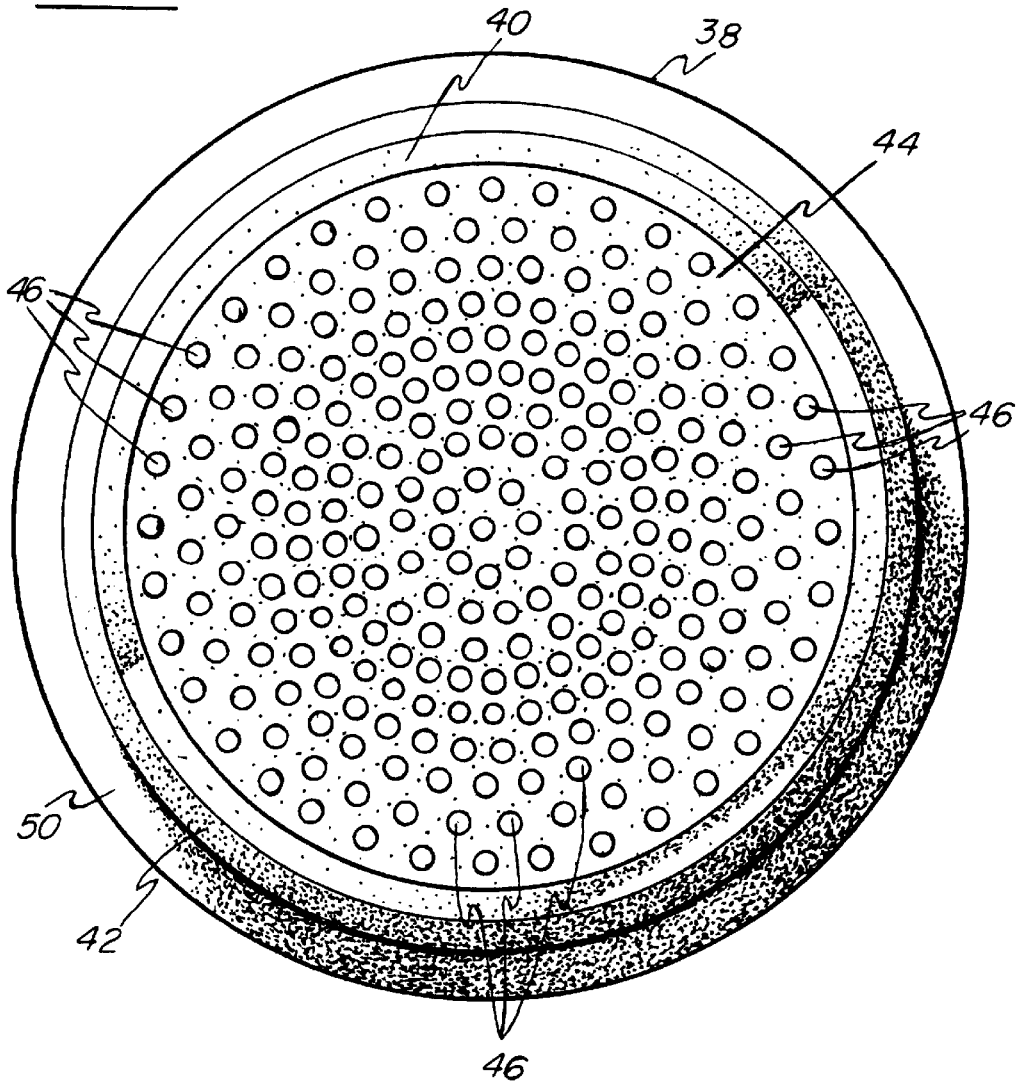
FIG. 3 is a top plan view of the adsorbent package shown in FIG. 1.

With reference now to FIGS. 1–3, the filter cap 38 includes a body 40 preferably molded from a thermoplastic material. The preferred material is a polypropylene, however any similar soft pliable thermoplastic may be readily substituted therefor. The material selected should preferably tolerate temperatures within a range of −20° to 250° F. and should be compatible with the particular refrigerant used in the air conditioning system.

The body 40 comprises a cylindrical side wall or skirt 42 supporting a porous end wall 44. The porous end wall 44 is preferably integrally molded with the cylindrical side wall 42 and includes a plurality of apertures 46 (FIG. 3). The apertures 46 are sized to have a diameter large enough to permit refrigerant flow therethrough but small enough to prevent passage of the desiccant 30. In an alternative embodiment of the present invention, the porous end wall 44 may comprise a screen material fixed to the side wall 42.

Figure 4:
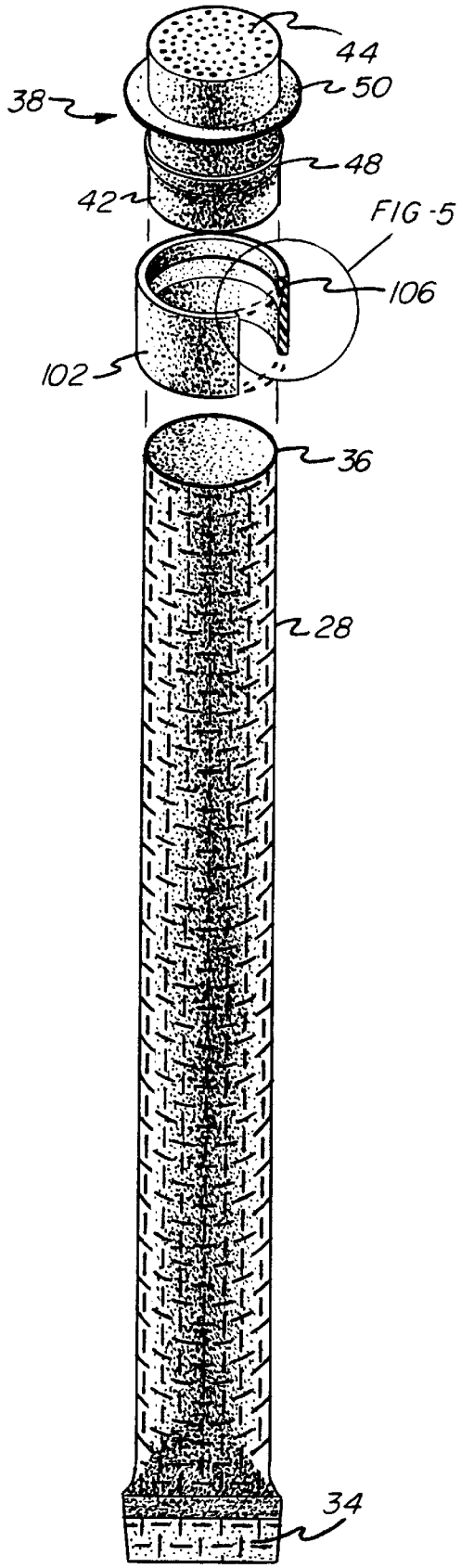
FIG. 4 is an exploded orthogonal view of another embodiment of an adsorbent package in accordance with the invention.

In the embodiment shown in FIGS. 1–3, an attachment device, preferably an annular attachment ring 48, extends radially outwardly from the skirt and is slidably received within the pouch 28 for securing the desiccant bag 26 to the cap 38. In this embodiment of the invention, the pouch is ultrasonically welded to the attachment ring 48. It should be appreciated that other means of attachment, including heat, RF, and vibration welding may be readily substituted therefor. Alternatively, and as shown in FIG. 4, the pouch 28 may be secured to the cap 38 by means of a mechanical fastener, such as a snap ring.

A sealing ring 50 extends radially outwardly from, and is preferably integrally formed with, the body 40 proximate the end wall 44. The sealing ring 50 is dimensioned to be concentrically received within and sealingly engage the cylindrical side wall 14 of the canister 12. As described above, the sealing ring 50 should be sufficiently resilient so as to provide sealing engagement with the canister side wall 14. The sealing ring 50 provides a living seal to prevent refrigerant flow between the end cap 38 and the side wall 14.

In operation, refrigerant enters the accumulator 10 through the inlet opening 20 of the canister 12 as indicated by arrow 52 in FIG. 2. The refrigerant is directed through the apertures 46 in the porous end wall 44 by the sealing ring 50. As may be appreciated, fluid flow is not permitted around the cap 38 due to the seal formed between the sealing ring 50 and the canister 12.

Refrigerant flows through the cap 38 and into the desiccant bag 26. Moisture is removed from the refrigerant by the desiccant 30 while solid particles are filtered by the pouch 28 and apertures 46. The treated refrigerant then exits the accumulator 10 through the outlet 22 in the canister 12 as indicated by arrow 54 in FIG. 2.

As may be appreciated, the present invention provides an adsorbent package 24 which efficiently removes moisture and filters solid particles from a refrigerant entering a fluid flow tube or canister structure such as an accumulator or receiver/drier.

Figure 5:
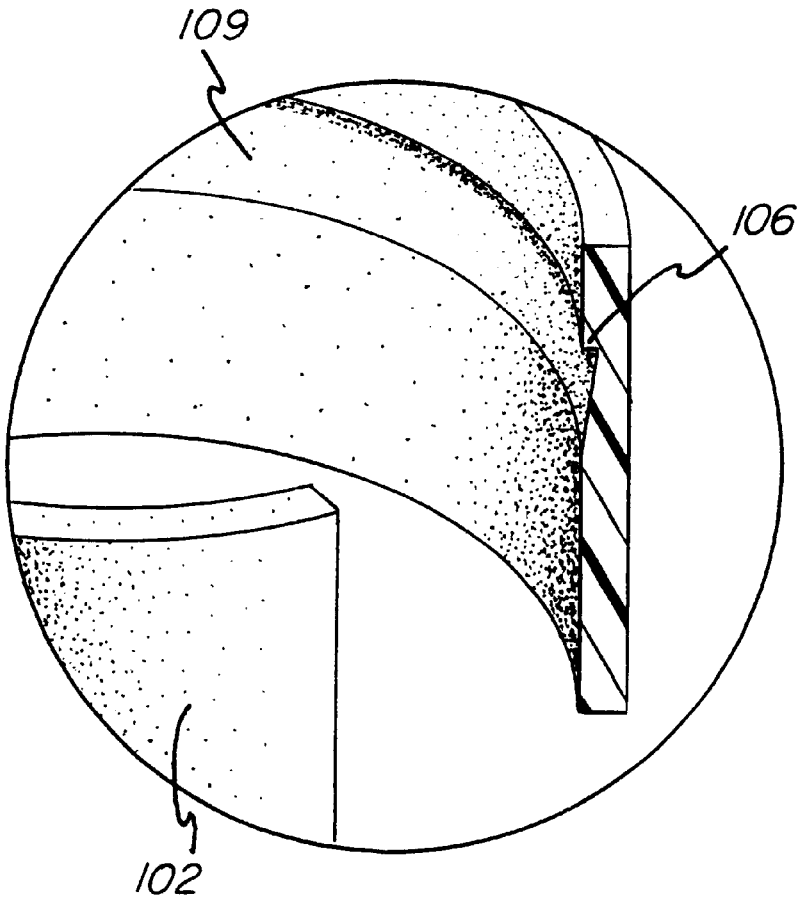
FIG. 5 is a magnified view of a portion of the adsorbent package shown in FIG. 4.

Turning now to FIGS. 4 and 5, there is shown another embodiment wherein an annular snap ring 102 is used to securely fasten the top of the pouch 28 to the cap 38. Here, attachment ring 48 is provided circumferentially around the body 40 of the cap. After the requisite amount of desiccant is supplied to the pouch, end 36 of the pouch 28 is slidably received over the attachment ring 48. Snap ring 102 having ridge 106 formed along its internal diameter is then slid up over the ridge or ring 48 to firmly lock the pouch within the grasp of the engaging ridge members 106, 48. In this manner, if desired, the pouch can be snugly secured to the cap without the need of a heat or ultrasonic sealing of the cap over the top portion of the pouch. As shown best in FIG. 5, the ridge 106 is directly axially above a ramp 109 or inclined surface to help ensure locking of the ridge 106 over the attachment ring 48 that is formed on the skirt of the cap member.

Figure 6:
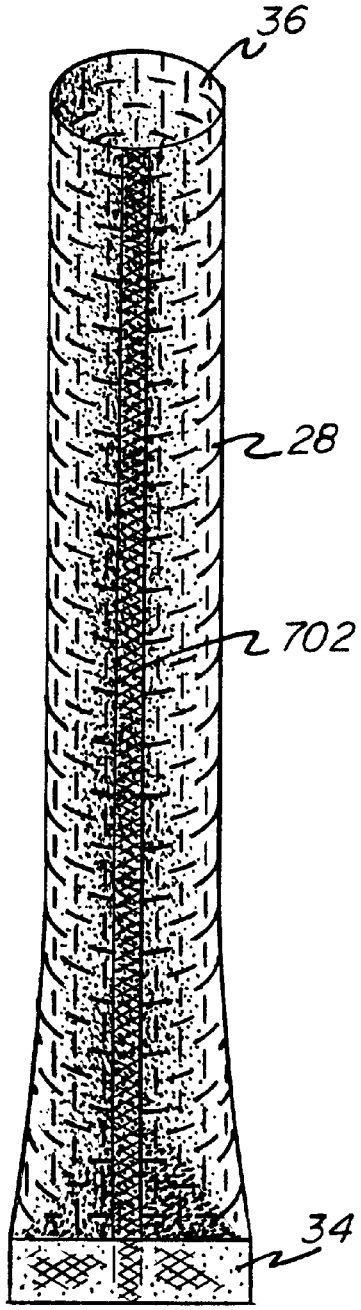
FIG. 6 is an orthogonal view of the adsorbent package shown in FIG. 4 but prior to insertion of the integral cap and filter structure therein.

FIG. 6 shows the pouch of FIG. 4 in position prior to filling of the desiccant therein and, ipso facto, prior to insertion of the cap into the end 36 of the pouch and insertion of the snap ring 102 over the body 40 of the cap. It is noted here that both a longitudinal seam 702 and end seam 34 are provided in the strip of textile fabric to form the open ended tubular shaped pouch shown in the drawing. These seams, as aforementioned, are preferably formed by ultrasonic welding means, but other sealing methods may also be used.

Figure 7:
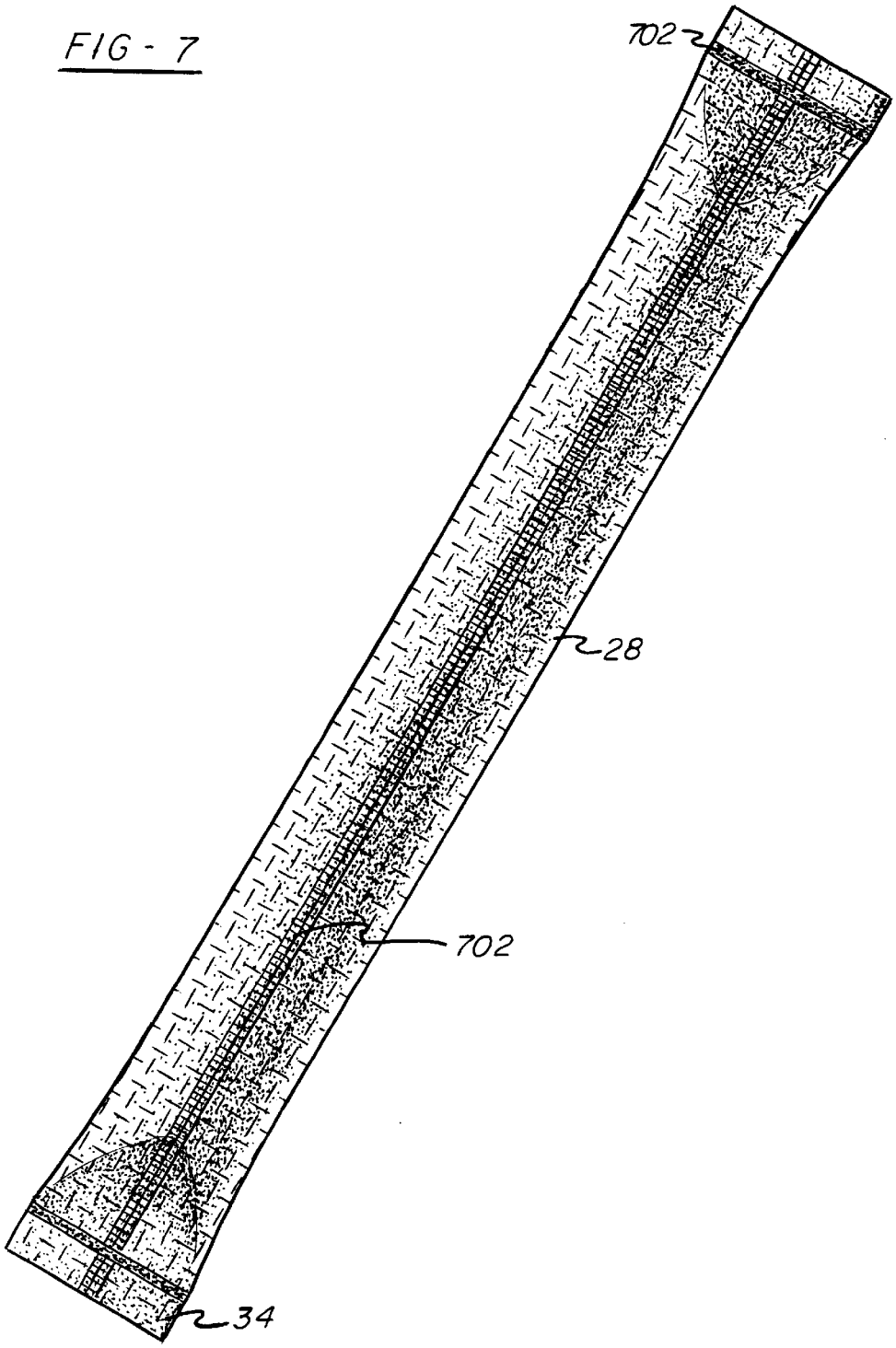
FIG. 7 is an orthogonal view of another embodiment of an adsorbent package in accordance with the invention.

FIG. 7 shows another embodiment of the invention in which the cap and associated filter are not used. This pouch is designed for snug, frictional engagement within the confines of a small diameter canister of the type normally encountered in the receiver/drier of an integrated condenser/receiver of the type described above and wherein one particular embodiment is shown in U.S. Pat. No. 5,813,249. Here, in addition to seams 34 and 702, a top end seam 704 is provided to form the closed pouch structure.

Figure 8:
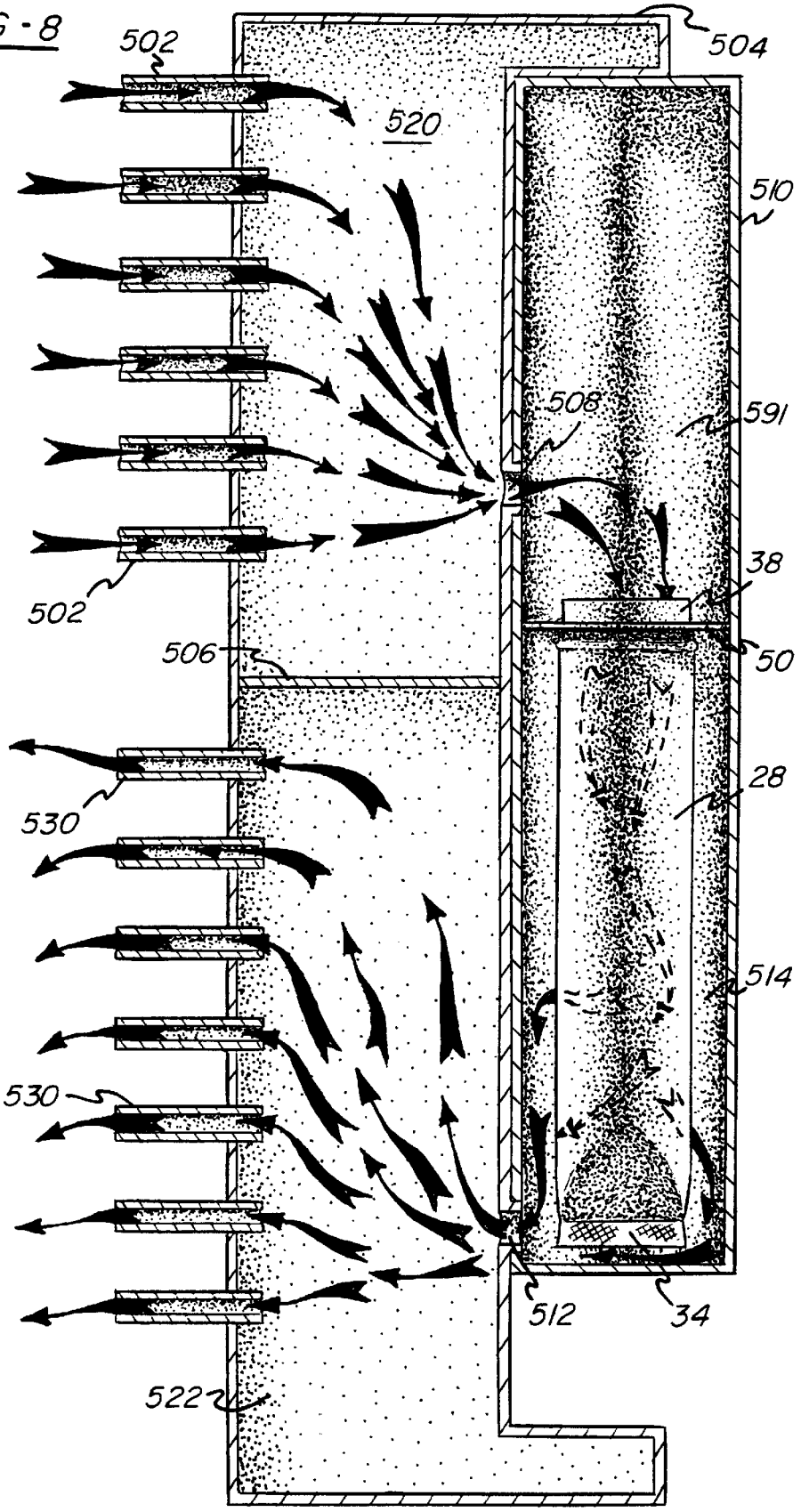
FIG. 8 is a schematic, fragmentary view of a portion of an integral condenser-receiver with the adsorbent package of the invention positioned in the receiver portion of the assembly.

FIG. 8 is a fragmentary schematic of an integrated condenser/receiver of the type shown in the '249 patent shown here with a small diameter adsorbent package of the invention disposed within the receiver. Here, condenser inlet tubes 502 communicate with the upstream section 520 of generally cylindrical header 504. The header is divided into two sections by partition 506. Inlet 508 provides communication for refrigerant flow from the condenser through the header 504 and into receiver 510. As is typical in some integral condenser receiver structures, the receiver is juxtaposed alongside the condenser header 504 and is directly connected thereto by welding, brazing, or other conventional joining techniques.

Quite typically, the diameter of the receiver canister is quite small—on the order of about 18 mm–35 mm. This necessitates that the working diameter or interior area of the desiccant containing pouch should be such as to allow for adequate volume of desiccant material therein, and the interior diameter of the package should also allow for containment of a tracer dye wafer therein, without impeding the flow of the refrigerant containing fluid therethrough.

As shown in FIG. 8, the pouch 28 of the invention is snugly engaged within the confines of the receiver canister. Outlet 512 provides fluid communication between the downstream end 514 of the receiver and downstream section 522 of the header 504. The downstream section of the header communicates with supercooler tubes 530.

The FIG. 8 apparatus operates to permit condensed refrigerant flow from the condenser tubes 502 into the upstream section 520 of header 504. This condensed refrigerant, carrying oil, some moisture and possibly solids therein, flows into the upstream portion 591 of receiver 510 through inlet 508. The fluid mix then flows downstream as shown through the filter cap 38 and desiccant bag 28 into the downstream section 514 of the header and then into the supercooling unit.

As stated above, and contrary to prior indications, we have found that the pouch 28 is advantageously formed of non-woven spun bonded nylon material such as that sold under the previously mentioned PBN-II designation. This material is supplied in the thickness of from about 3 mils.–22 mils. At present, it is preferred to employ a thickness of about 15 mils. This ensures adequate cross-sectional area permitting dye wafer insertion into the pouch and adequate desiccant volume and fluid permeation. Air permeability for this material reportedly ranges from about 100 cfm/ft$^2$ to about 1380 cfm/ft$^2$. Air permeability of the preferred 15 mil thickness is about 200 cfm/ft$^2$ to 300 cfm/ft$^2$.

Although this invention has been described in conjunction with certain specific forms and modifications thereof, it will be appreciated that a wide variety of other modifications can be made without departing from the spirit and scope of the invention.

What is claimed is:

1. In an integrated condenser receiver apparatus of the type wherein a fluid flow canister is juxtaposed along said apparatus for flow of refrigerant fluid therethrough, a desiccant containing package adapted for snug receipt within said canister, said package comprising a pouch of non-woven spun bonded nylon material.

2. Desiccant containing package as recited in claim 1 wherein said package is adapted for snug reception within an internal diameter of said canister of about 18 mm–35 mm.

3. Desiccant containing package as recited in claim 2 wherein said non-woven spun bonded nylon material has a thickness of about 3 mils.–22 mils.

4. Desiccant containing package as recited in claim 3 wherein said non-woven spun bonded nylon material has a thickness of about 15 mils.

5. Desiccant containing package as recited in claim 2 wherein said non-woven spun bonded nylon material has an air permeability of between about 100 cfm/ft$^2$ to about 1380 cfm/ft$^2$.

6. Desiccant containing package as recited in claim 5 wherein said non-woven spun bonded nylon material has an air permeability of between about 200 cfm/ft$^2$ to 300 cfm/ft$^2$.

7. In combination, a desiccant containing package as recited in claim 1 and a tracer dye wafer enclosed in said package.

8. Desiccant containing package comprising an elongated pouch, said pouch comprising a first and second end portion, one of said first or second end portions being sealed, a cap member sealingly received in said other end portion, said cap portion comprising a body and a filter surface having a plurality of filter apertures therein.

9. Desiccant containing package as recited in claim 8 wherein said cap further comprises a sealing rim extending outwardly from said body.

10. Desiccant containing package as recited in claim 8 wherein cap portion body further includes a skirt member and an attachment ring formed around said skirt.

11. Desiccant containing package as recited in claim 10 wherein said other end portion of said pouch is sealingly fused over said attachment ring.

12. Desiccant containing package as recited in claim 10 further comprising a snap ring having an internally facing ridge member, said other end portion of said pouch interposed between said attachment ring and said ridge member and securely fastened to said cap thereby.

13. Desiccant containing package as recited in claim 8 wherein said pouch is composed of a non-woven spun bonded nylon material.

* * * * *